US008672168B2

(12) United States Patent
Triquet et al.

(10) Patent No.: US 8,672,168 B2
(45) Date of Patent: Mar. 18, 2014

(54) SEALING DISC WITH TAB FOR CLOSING A CONTAINER HAVING A PLUG OR CAP CLOSURE AND FABRICATION METHOD

(75) Inventors: Stephane Triquet, Ecully (FR); Remy Bischoff, Limas (FR)

(73) Assignee: Manufacture Generale de Joints, Chazay d'Azergues (FR)

( * ) Notice: Subject to any disclaimer, the term of this patent is extended or adjusted under 35 U.S.C. 154(b) by 656 days.

(21) Appl. No.: 12/200,364

(22) Filed: Aug. 28, 2008

(65) Prior Publication Data

US 2009/0078671 A1 Mar. 26, 2009

(30) Foreign Application Priority Data

Sep. 25, 2007 (FR) ..... 0757839

(51) Int. Cl.
*B65D 17/34* (2006.01)

(52) U.S. Cl.
USPC ..... 220/359.2; 220/359.3; 215/232; 215/347

(58) Field of Classification Search
USPC ..... 220/359.2, 359.1, 258.2, 359.3, 359.4; 215/232, 258, 341, 347, 349, 350
See application file for complete search history.

(56) References Cited

U.S. PATENT DOCUMENTS

| | | | | |
|---|---|---|---|---|
| 4,822,326 | A * | 4/1989 | Ullman et al. | 493/77 |
| 5,372,268 | A * | 12/1994 | Han | 215/232 |
| 6,378,715 | B1 * | 4/2002 | Finkelstein et al. | 215/341 |
| 2008/0073308 | A1 | 3/2008 | Yousif | |
| 2011/0089177 | A1 * | 4/2011 | Thorstensen-Woll | 220/359.4 |

FOREIGN PATENT DOCUMENTS

| | | | |
|---|---|---|---|
| CA | 2019501 | A1 | 12/1990 |
| DE | 9108868 | U1 | 9/1991 |
| FR | 2716407 | A1 | 8/1995 |

* cited by examiner

*Primary Examiner* — Jeffrey Allen
(74) *Attorney, Agent, or Firm* — Tech Valley Patent, LLC; John Pietrangelo

(57) ABSTRACT

Sealing disc (1) for closing a container having a plug or cap closure, comprising a support (2) to be positioned at the bottom of the plug or of the cap, joined by means of a temporary adhesive (7) to a membrane seal (3) to be sealed on the mouth of the container, the membrane seal (3) being provided on all or part of its thickness with a prolongation constituting a pull tab (4), characterized in that the whole surface of the tab is folded back on the face of the membrane seal (3) in contact with the corresponding face of the support (2).

19 Claims, 2 Drawing Sheets

SEALING DISC WITH TAB FOR CLOSING A CONTAINER HAVING A PLUG OR CAP CLOSURE AND FABRICATION METHOD

CROSS-REFERENCE TO RELATED APPLICATIONS

This application claims priority from pending French Patent Application FR 0757839, filed on Sep. 25, 2007, the disclosure of which is included by reference herein in its entirety.

BACKGROUND

1. Field of the Invention

The invention relates to a novel sealing disc with tab for closing a container having a plug or cap closure and to its method of fabrication.

2. Description of Related Art

The tightness of containers having a plug or cap closure, prior to their initial opening, is obtained by means of a sealing disc which may be bondable or sealable to the mouth, in particular with heat.

BRIEF SUMMARY OF ASPECTS OF THE INVENTION

The invention relates more particularly to a heat-sealable sealing disc.

Such a sealing disc consists of a membrane seal placed on the whole periphery of the upper rim of the neck of the container or mouth, thereby isolating the container from the exterior, and on the other hand, of a generally thicker support, inserted, without being necessarily fixed, in the bottom of the plug. Prior to the initial opening of the container, the support and the membrane seal may be joined by means of a temporary adhesive.

The role of the membrane seal is firstly to make the container pilferproof before the initial opening. Moreover, it provides the primary tightness with regard to the exterior. Besides, it must develop certain properties of compatibility with the contents which it is presumed to isolate and, for example, must be of food grade insofar as the content itself is a foodstuff As to the support, it is intended to absorb the tolerances between the bottom of the cap and/or the plug and the upper part of the neck of the container, and furthermore, to provide the secondary tightness insofar as the membrane seal has been partly or fully removed. It is therefore able to withstand some compression with a memory effect, specifically in order to absorb these tolerances.

In practice, the sealing disc is inserted at the bottom of the cap or the plug. Once the container is filled, the plug or cap provided with the sealing disc is screwed or clipped to the container. The membrane seal part of the sealing disc is then in contact with the mouth. The membrane seal is then sealed to the mouth by induction heat-sealing. This heat-sealing is made possible by the combined action of a conducting material, inserted into the thickness of the sealing disc, which heats under the effect of an electrical induction heater, causing the softening of the sealing film on the mouth. The conducting material may be inserted either in the support, or in the membrane seal. It is usually inserted in the thickness of the membrane seal. Upon opening the container for the first time, the support inserted at the bottom of the plug is detached from the membrane seal which remains sealed on the mouth. It is only after the membrane seal is removed by the consumer, that the tightness, in the closed position of the container, is no longer provided exclusively by the support portion of the sealing disc which is applied by compression on the mouth.

For effective and easy pulling of the membrane seal by the consumer, it has been proposed to join an easily graspable tab to the said membrane seal, as described for example in document FR-A-2 716 407.

However, the presence of this projecting tab makes it difficult to position the sealing disc at the bottom of the plug or of the cap, due to the extra lateral thickness. It is also difficult to securely position the tab with regard to the thread or to the clips arranged in the plug or the cap to avert the risk of damage to the tab upon the closure or opening of the plug or the cap.

Document DE 3920324 describes a sealing disc that is induction heat-sealable, consisting of a support and a membrane seal provided with a tab, the support and the membrane seal not being joined to one another at any time. Out of three embodiments illustrated, only one (FIG. 1) comprises a tab folded back on its whole surface. The tab consists of the combination of a membrane and a sealing layer, the aluminium sheet being positioned in the support.

The problem that the invention proposes to solve is to develop a sealing disc with tab of the type described in document DE 3920324, which has a layer of temporary adhesive between the support and the membrane seal but without necessarily incurring risks of bonding of the tab at the time of the assembly operation with the temporary adhesive, or during the heat-sealing operation.

To solve the problem of the risk of bonding during the induction heating, the Applicant has developed a sealing disc provided with a tab, of which the folded back portion in contact with the support is devoid of a heat-sealing layer, and also a method for fabricating the said sealing disc.

In other words, the invention relates to a heat-sealable sealing disc for closing a container having a plug or cap closure, comprising a support to be positioned at the bottom of the plug or of the cap, and a membrane seal comprising at least one reinforcing film and a heat-sealing film for application to the mouth of the container, the membrane seal being provided with a prolongation constituting a pull tab, whereof the whole surface is folded back on the face of the membrane seal in contact with the corresponding face of the support.

This sealing disc is characterized in that the portion of the tab in contact with the support after the latter has been folded, is devoid of heat-sealing film and in that the support and the membrane seal are joined by means of a temporary adhesive.

According to the invention, the tab consists of a prolongation formed in all or part of the thickness of the membrane seal. It never consists of a tab added on to the membrane seal.

The number of layers constituting the support and the membrane seal is not limited, it being understood that binders can be added in particular for bonding the films together.

Obviously, the sealing disc of the invention has a shape adapted to the shape of the container and of the plug and may be circular or parallelepiped-shaped.

As to the support, it may be produced from any type of compressible material with recovery memory, particularly of expanded polyethylene or expanded polypropylene, optionally provided on at least one of its two faces with a polypropylene or polyethylene film, to impart some stiffness. It may also be made from cardboard. In one particular embodiment, the support contains a sheet of conducting material which heats when it conveys an induced electrical current (referred to in the rest of the description and in the claims as "conducting material") on the assumption that the membrane seal is devoid of the said sheet of conducting material. In practice, the supports considered have a thickness of between 0.5 and 4 mm, advantageously between 1 and 2 mm.

The membrane seal will now be described in greater detail.

In most cases, a sheet of conducting material, in particular a sheet of aluminium, is inserted in the membrane seal and not in the support, whereby, in combination with the heat-sealing film, it enables the induction heat-sealing of the sealing disc on the mouth.

In other words, in practice, the membrane seal comprises a sheet made from a conducting material, between the reinforcing film and the heat-sealing film.

According to the invention, the sealing disc may have two distinct general embodiments, respectively one embodiment in which the heat-sealing film does not cover the lower face of the tab, and one embodiment in which the whole lower face of the tab is covered with heat-sealing film.

1. Embodiment in Which the Heat-Sealing Film Does Not Cover the Lower Face of the Tab In a first embodiment, the tab is made exclusively in the prolongation of the reinforcing film, that is on only part of the thickness of the membrane seal. The tab in this case consists exclusively of the reinforcing film applied on the upper face of the aluminium sheet. It follows that the actual membrane seal has a three-layer structure (heat-sealing plastic film/conducting material/reinforcing film), whereas the tab has a single-layer structure (reinforcing film). This particular embodiment serves to avoid the potential risks of bonding at the time when the tab is heat-sealed in the folded back position with the support, due to the absence of the sealing film. Another advantage resides in the application of the electrical field at the time of induction heating, which is uniformly distributed at the periphery of the aluminium sheet, and which is not necessarily the case when the tab is in the prolongation of the said sheet. The latter hypothesis incurs the risks of leaks due to the imperfect sealing of the membrane seal to the mouth at each side of the base of the tab.

In the embodiment discussed above, the ink printing can be performed directly on the aluminium sheet.

A second alternative consists in providing not one but two reinforcing films. In this case, the membrane seal comprises two superimposed reinforcing films, respectively a lower reinforcing film and an upper reinforcing film, a sheet of conducting material being inserted between the said lower reinforcing film and the heat-sealing film.

In this embodiment, the tab is advantageously arranged exclusively in the prolongation of the upper reinforcing film. In this case, the first reinforcing film covers the whole upper surface of the aluminium sheet, while the second film covers the whole surface of the first film and has a prolongation constituting the tab.

In an improved embodiment, the upper reinforcing film itself consists of two superimposed reinforcing films, between which a printing can be implied. In this case, the tab is arranged in the prolongation of the two reinforcing films constituting the upper reinforcing film.

2. Embodiment in Which the Whole Tab is Covered with Heat-Sealing Film

In a particular embodiment, the tab is produced on the whole of the thickness of the membrane seal. Advantageously, the membrane seal comprises an aluminium sheet whereof the upper face is covered with a reinforcing film and whereof the lower face is covered with a heat-sealing film. In this case, the tab has two equal-area zones separated by a transverse median folding line, respectively a basal zone and a terminal zone, the lower face of the terminal zone being joined to the lower face of the basal zone after folding along the abovementioned line. Accordingly, when the tab is folded back on the membrane seal, the upper face of the basal zone is in contact with the upper face of the reinforcing film and the upper face of the terminal zone is in contact with the lower face of the support. Obviously, the number of reinforcing films may be increased according to the desired characteristics.

In general, the material constituting the tab and hence the reinforcing film is selected so that the strength of the said material is greater than the pulling force on the membrane seal.

In practice, the reinforcing film is for example a bi-oriented polyester film having a thickness of between 4 and 40 μm.

According to another feature, the heat-sealing film is made from a material selected from the group comprising polyethylene, polypropylene or polyester.

Furthermore, the aluminium sheet and the heat-sealing film are joined by means of a binder such as for example a two-component isocyanate-hydroxyl adhesive. In another embodiment, the aluminium sheet is coated with a heat-sealing layer.

In all cases, in practice, the membrane seal has a thickness of between 20 and 600 μm.

As to the temporary joining between the support and the membrane seal, this can be obtained by means of a temporary adhesive applied in places at a plurality of points, for example microcrystalline wax or, advantageously by means of an extruded film consisting for example of a polymer such as polyethylene. The adhesive film may also be a co-extruded film, whereof each of the two faces has a different adhesive power, the more adhesive face being applied for example to the lower surface of the support, while the less adhesive face is applied to the upper face of the membrane seal. In practice, the co-extruded film is a film based on a polymer, generally synthetic, and selected carefully by a person skilled in the art in order to obtain the desired properties of differential bonding. Such polymers are for example polymers or co-polymers based on acetate, acrylate, polyethylene.

In general, the adhesive must be selected so that the joining force between the support and the membrane seal is lower than that of the heat-sealing layer to the mouth.

The invention also relates to a method for fabricating the heat-sealable sealing discs previously described.

1. Embodiment in Which the Heat-Sealing Film Does Not Cover the Lower Face of the Tab In this case, the inventive method comprises the following steps:

- tabs are precut in a reinforcing film strip,
- the whole surface of the tabs is mechanically overturned on the upper face of the reinforcing film strip,
- the lower face of the reinforcing film strip is then permanently joined to the heat-sealing film strip, the composite constituting the membrane seal strip,
- a support strip is prepared simultaneously,
- the support strip is then temporarily joined to the membrane seal by means of a temporary adhesive, to form the sealing disc strip, the sealing discs are cut out on the whole of the thickness of the sealing disc strip, to the desired shape, in a marked manner with regard to the tabs.

In a manner known per se, the reinforcing strip is fabricated by joining strips or films of material constituting the support, in particular those described above.

When the membrane seal contains a sheet of a conducting material, the lower face of the reinforcing film strip is joined to the conducting material sheet/heat-sealing film composite, at the upper face of the said sheet.

In the embodiment in which the membrane seal, in addition to the sheet of conducting material, contains a lower reinforcing film and an upper reinforcing film, the tab being arranged in the prolongation of the upper reinforcing film alone, the lower face of the upper reinforcing film strip is joined to the following composite: lower reinforcing film strip/conducting material sheet/heat-sealing film.

In the embodiment in which the upper reinforcing film itself consists of two reinforcing films, the tabs are precut in two previously joined upper reinforcing film strips before joining them to the following composite: lower reinforcing film strip/conducting material sheet/heat-sealing film.

In general, the joining force of the reinforcing film or films to the rest of the membrane seal must be greater than that of the heat-sealed layer on the mouth.

2. Embodiment in Which the Whole Tab is Covered with Heat-Sealing Film

When the membrane seal contains a sheet made from a conducting material, the membrane seal strip is fabricated by joining at least one reinforcing film with the sheet of conducting material and then the heat-sealing film.

The tab is then precut in the membrane seal strip and a transverse median folding line is then cut in the tab. The terminal part of the tab is then folded along the transverse median folding line, on the lower face of the basal part of the said tab, and the tab, which is then diminished by half of its surface, is then folded on the upper face of the membrane seal.

Simultaneously, a support strip is prepared, and the support strip is then temporarily joined to the membrane seal to form the sealing disc strip. The sealing discs are then cut out to the desired shape on the whole thickness of the sealing disc strip.

The methods described above are preferred embodiments of the invention and are non-limiting.

BRIEF DESCRIPTION OF THE DRAWINGS

The invention and the advantages thereof will appear more clearly from the following examples, in conjunction with the appended figures.

DETAILED DESCRIPTION OF ASPECTS OF THE INVENTION

EXAMPLE 1

Figure 1:
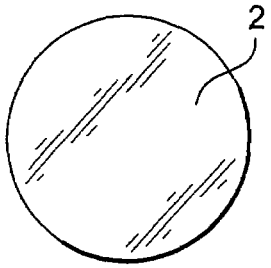
FIG. 1 is a schematic plan view of the support constituting the sealing disc of the invention.
Figure 2:
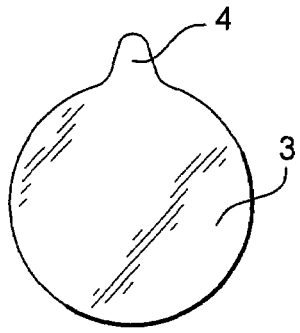
FIG. 2 is a plan view of the membrane seal constituting the sealing disc of the invention.
Figure 3:
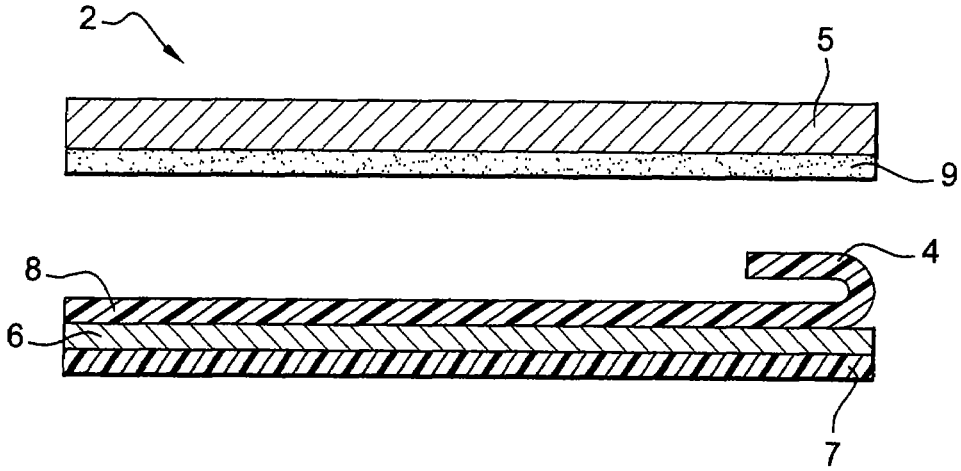
FIG. 3 shows a cross section of the sealing disc of the invention, before joining the membrane seal part and the support part according to a first embodiment.

A sealing disc according to the invention is an induction heat-sealable sealing disc. In particular, the sealing disc denoted in FIG. 1 by the general reference (1) consists of a support (2) (FIG. 1) and a membrane seal (3) (FIG. 2) provided with a tab (4). As shown in FIG. 3, the support comprises a layer (5) made from expanded polypropylene or polyethylene and has a thickness of between 1.4 and 1.7 mm. The membrane seal (3) is an induction heat-sealable membrane seal and consists of a sheet of aluminium (6) combined with a heat-sealable plastic film (7), such as polyethylene for example, by means of a binder not shown. The membrane seal is further provided with a reinforcing film (8) prolonged by the pull tab (4). As shown in FIG. 3, the pull tab (4) consists exclusively of the reinforcing film (8), which, within the sealing disc, and before detachment, is folded back on itself and on the whole of its length, between the upper face of the membrane seal (3) and the lower face of the support (2). According to the invention, the support and the membrane seal are joined by means of a temporary adhesive film (9) shown in FIG. 3. This temporary film is an extruded film of the polyethylene type.

In this embodiment, the membrane seal is provided with a reinforcing film applied to the surface of an aluminium sheet, and the tab consists exclusively of the reinforcing film.

In practice, these sealing discs are positioned as such at the bottom of the plug, the plug then being screwed or clipped, as applicable to the neck of the container. The sealing disc is induction heat-sealed.

Concerning the method, the membrane seal is first fabricated. For this purpose, the tabs are precut in the reinforcing film which is then overturned on the said film. The reinforcing film is wound and then unwound on the composite formed by the aluminium sheet and the heat-sealable film, the aluminium sheet being covered with a binder. The support strips are fabricated simultaneously. The support is joined to the membrane seal thus formed by means of a temporary adhesive. The sealing disc is cut out in the thickness to the desired shape and separated with regard to the positioning of the tab.

EXAMPLE 2

Figure 4:
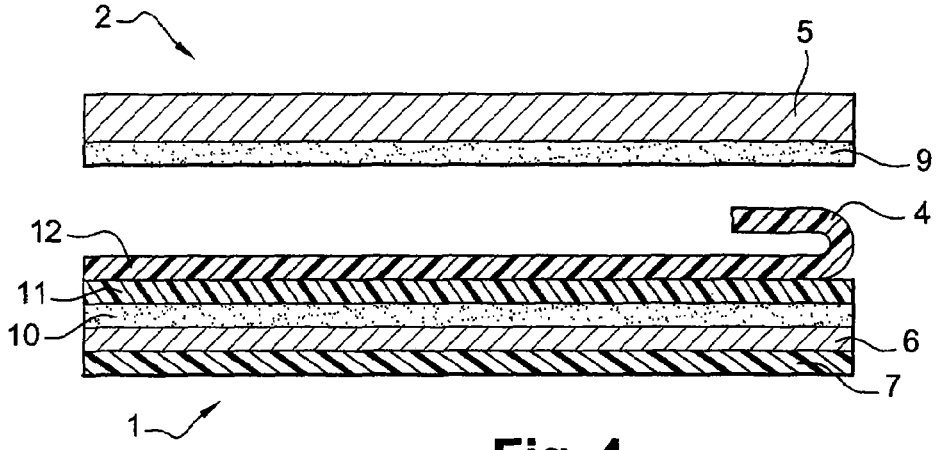
FIG. 4 shows a cross section of the sealing disc of the invention, before joining the membrane seal part and the support part according to a second embodiment.

In this example shown in FIG. 4, the membrane seal contains a printing layer (10), which is covered with a first reinforcing film (11) whereof the surface corresponds to that of the membrane seal. The first reinforcing film (11) is covered in turn with a second reinforcing film (12), which has a prolongation constituting the actual tab (4).

The fabrication method is identical to the previous one, except that the second reinforcing film having the precut is joined to the composite formed by the first reinforcing film/aluminium/heat-sealing film.

EXAMPLE 3

Figure 5:
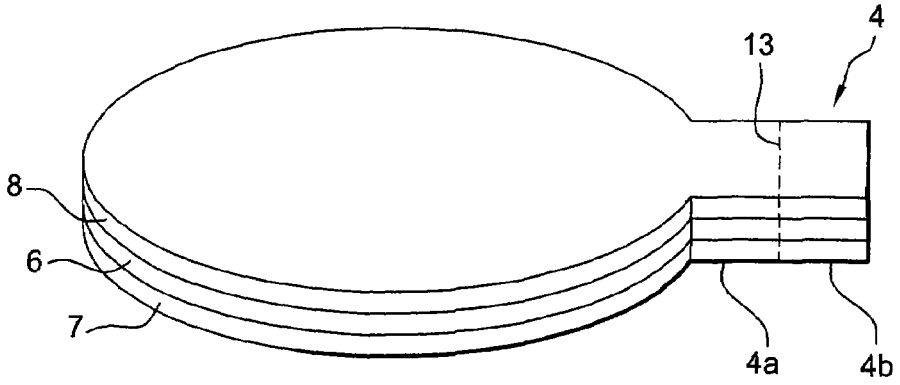
FIG. 5 shows a membrane seal in a third embodiment, in which the tab is arranged on the whole thickness of the membrane seal.

In this embodiment, the heat-sealable sealing disc has a tab (4) made in the whole thickness of the sealing disc (FIG. 5). More precisely, as in FIG. 2, the membrane seal (3) consists, from the bottom upward, of a heat-sealing film (7), a sheet of conducting material (6) and a reinforcing film (8). The tab (4) is divided into two equal parts, respectively a basal part (4*a*) and a terminal part (4*b*) separated by a transverse median line (13).

Figure 6:
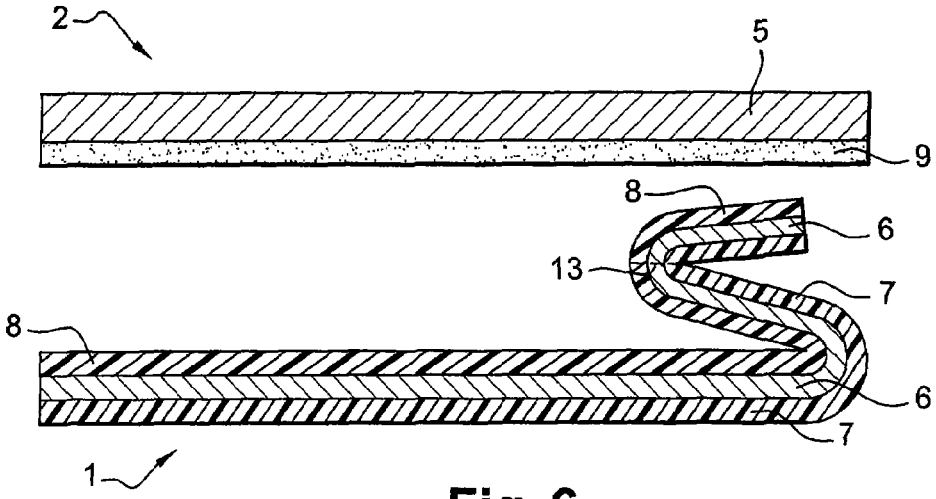
FIG. 6 shows a cross section of the sealing disc in FIG. 5, before joining the membrane seal part and the support part according to a second embodiment.

FIG. 6 shows the sealing disc before joining the membrane seal part to the support part. As shown in this figure, the upper face of the part (4*a*) is folded back on the upper face of the reinforcing film (8), while the lower face of the part (4*b*) covered with heat-sealing film (7) is folded back on the lower face of the part (4*a*) also covered with heat-sealing film. The parts (4*a*) and (4*b*) are thus joined to one another. The upper face of the part (4*b*), devoid of heat-sealing film, and after detachment from the support, is in contact with the lower face of the said support.

The invention and the advantages thereof appear clearly from the above description, notably the advantage of producing a sealing disc with tab in which the tab is folded back in the thickness of the sealing disc, so as to permit a proper positioning of the sealing disc at the bottom of the plug without the risk of creating an extra thickness or of tearing the tab at the time of the opening or closing of the container. Furthermore and above all, the absence of a heat-sealing film on the part of the tab in contact with the support makes it possible, despite the presence of a temporary binder, to overcome the problem of bonding of the tab at the time of opening.

The invention claimed is:

1. Heat-sealable sealing disc for closing a container having a plug or cap closure, the sealing disc comprising:

a support to be positioned at the bottom of the plug or of the cap, and a membrane seal comprising at least one reinforcing film and a heat-sealing film for application to a mouth of the container, the membrane seal having a prolongation comprising a pull tab, wherein the whole surface of the pull tab is folded back on a face of the membrane seal in contact with a corresponding face of the support, wherein a portion of the tab in contact with the support after the tab has been folded is devoid of heat-sealing film and the support and the membrane seal are joined by means of a temporary adhesive; and wherein the temporary adhesive comprises a co-extruded film having two faces, and wherein a more adhesive face is applied to a lower surface of the support and a less adhesive face is applied to an upper face of the membrane seal.

2. Sealing disc according to claim 1, wherein the support is made from expanded polyethylene or from expanded polypropylene, optionally provided with a polypropylene film on at least one of its two faces.

3. Sealing disc according to claim 1, wherein the membrane seal comprises, between the reinforcing film and the heat-sealing film, a sheet made from a conducting material.

4. Sealing disc according to claim 3, wherein the tab is produced exclusively in the prolongation of the reinforcing film.

5. Sealing disc according to claim 1, wherein the membrane seal comprises two superimposed reinforcing films, a lower reinforcing film and an upper reinforcing film respectively, a sheet of conducting material being inserted between the said lower reinforcing film and the heat-sealing film.

6. Sealing disc according to claim 5, wherein the tab is arranged exclusively in the prolongation of the upper reinforcing film.

7. Sealing disc according to claim 5, wherein the upper reinforcing film itself consists of two superimposed reinforcing films, and in that the tab is arranged in the prolongation of the two reinforcing films constituting the upper reinforcing film.

8. Sealing disc according to claim 1, wherein the membrane seal comprises a sheet of aluminium whereof the upper face is covered with the reinforcing film and whereof the lower face is covered with the heat-sealing film, and in that the tab is arranged in the prolongation of the membrane seal on the whole of its thickness and has two equal-area zones separated by a transverse median folding line, a basal zone and a terminal zone respectively, the lower face of the terminal zone being joined to the lower face of the basal zone after folding along the median line.

9. Sealing disc according to claim 1, wherein the reinforcing film is a film of bio-oriented polyester having a thickness of between 4 and 40 μm.

10. Method for fabricating a heat-sealable sealing disc for closing a container having a plug or cap closure, the method comprising:

providing a support to be positioned at the bottom of the plug or of the cap, providing a membrane seal comprising at least one reinforcing film and a heat-sealing film for application to a mouth of the container, the membrane seal having a prolongation comprising a pull tab, folding the pull tab back on the face of the membrane seal in contact with a corresponding face of the support, wherein a portion of the tab in contact with the support after the folding is devoid of heat-sealing film, joining the support and the membrane seal by means of a temporary adhesive, wherein the tem adhesive comprises a co-extruded film having two faces, and wherein a more adhesive face is applied to a lower surface of the support and a less adhesive face is applied to an upper face of the membrane seal.

11. Method according to claim 10, wherein providing the membrane seal further comprises providing a membrane seal containing a sheet of conductive material positioned between the at least one reinforcing film and the heat-sealing film, wherein the method further comprises joining the at least one reinforcing layer to the sheet of conductive material.

12. Method according to claim 11, wherein the at least one reinforcing film comprises a lower reinforcing film and an upper reinforcing film, wherein the pull tab comprises a prolongation of the upper reinforcing film, and wherein joining the at least one reinforcing layer to the sheet of conductive material comprises joining the lower reinforcing film to the sheet of conductive material.

13. Method according to claim 12, wherein the upper reinforcing film comprises two upper reinforcing films, and wherein the pull tab in the upper reinforcing film comprises a pull tab in each of the two upper reinforcing films.

14. Sealing disc according to claim 1, wherein, after the tab has been folded, the temporary adhesive is provided to substantially an entire surface of the membrane seal.

15. Sealing disc according to claim 1, wherein the co-extruded film comprises an acetate, an acrylate or a polyethylene.

16. Sealing disc according to claim 1, wherein the temporary adhesive comprises an adhesive that provides a joining force between the support and the membrane seal that is lower that a joining force between the heat-sealing film and the mouth of the container.

17. Method according to claim 10, wherein providing the membrane seal comprising at least one reinforcing film, the heat-sealing film, and the prolongation comprising the pull tab comprises precutting the pull tab in the at least one reinforcing film.

18. Method according to claim 10, wherein folding the pull tab back on the face of the membrane seal comprises mechanically overturning the pull tab on an upper face of the at least one reinforcing film.

19. Method according to claim 10, wherein the method further comprises joining a lower face of the at least one reinforcing film with the heat-sealing film.

* * * * *

UNITED STATES PATENT AND TRADEMARK OFFICE

CERTIFICATE OF CORRECTION

PATENT NO. : 8,672,168 B2
APPLICATION NO. : 12/200364
DATED : March 18, 2014
INVENTOR(S) : Stephane Triquet et al.

It is certified that error appears in the above-identified patent and that said Letters Patent is hereby corrected as shown below:

In the Claims

Column 8, line 19, replace “tem” with “temporary”

Signed and Sealed this
Sixteenth Day of September, 2014

Michelle K. Lee

Michelle K. Lee
*Deputy Director of the United States Patent and Trademark Office*